US011815095B2

(12) United States Patent
Shaw et al.

(10) Patent No.: US 11,815,095 B2
(45) Date of Patent: Nov. 14, 2023

(54) POWER SAVING VACUUMING PUMP SYSTEM BASED ON COMPLETE-BEARING-SEALING AND DRY-LARGE-PRESSURE-DIFFERENCE ROOT VACUUMING ROOT PUMPS

(71) Applicants: Raymond Zhou Shaw, Shanghai (CN); Yi Rong, Shanghai (CN); Bin Wu, Shanghai (CN)

(72) Inventors: Raymond Zhou Shaw, Shanghai (CN); Yi Rong, Shanghai (CN); Bin Wu, Shanghai (CN)

(73) Assignees: ELIVAL CO., LTD, Shanghai (CN); Raymond Zhou Shaw, Shangahi (CN); ELIVAC Inc.

( * ) Notice: Subject to any disclaimer, the term of this patent is extended or adjusted under 35 U.S.C. 154(b) by 132 days.

(21) Appl. No.: 17/400,141

(22) Filed: Aug. 12, 2021

(65) Prior Publication Data

US 2021/0372404 A1 Dec. 2, 2021

Related U.S. Application Data

(63) Continuation-in-part of application No. 16/316,626, filed on Jan. 10, 2019, now abandoned.

(51) Int. Cl.
*F04C 25/02* (2006.01)
*F04C 28/24* (2006.01)
(Continued)

(52) U.S. Cl.
CPC ..... *F04C 25/02* (2013.01); *F04C 18/126* (2013.01); *F04C 23/003* (2013.01); *F04C 28/02* (2013.01);
(Continued)

(58) Field of Classification Search
CPC ..... F04C 18/126; F04C 23/003; F04C 25/02; F04C 28/02; F04C 28/08; F04C 28/24;
(Continued)

(56) References Cited

U.S. PATENT DOCUMENTS 2,936,107 A * 5/1960 Blackburn ..... F04C 28/08 417/247
2,971,691 A * 2/1961 Lorenz ..... F04C 23/005 417/69
(Continued)

FOREIGN PATENT DOCUMENTS

CN 204574855 U * 8/2015
CN 106014997 A * 10/2016
(Continued)

*Primary Examiner* — Alexander B Comley

(57) ABSTRACT

A power saving vacuuming pump system is based on complete-bearing-sealing and dry-large-pressure-difference root vacuuming root pumps includes an input valve at an input end of a vacuum space for receiving gas mixture of saturation water vapor and non-condensed air from a condenser of a power plant; a first root vacuum pump connected to the input valve for receiving gas mixture from the input valve and then compressing the gas mixture; a second root vacuum pump connected to the first root vacuum pump for receiving gas mixture from the first root vacuum pump and then compressing the gas mixture. Inner connection walls between the vacuum chamber and the two bearing chambers are installed respective bearings which are installed to be around the driving shaft, and thus all the vacuum chamber and the two bearing chambers are tightly sealed. The vacuum chamber is completely dried so as to prevent from internal emulsion.

5 Claims, 7 Drawing Sheets

(51) Int. Cl.

| | |
|---|---|
| ***F04C 28/08*** | (2006.01) |
| ***F04C 28/02*** | (2006.01) |
| ***F04C 23/00*** | (2006.01) |
| ***F04C 18/12*** | (2006.01) |

(52) U.S. Cl.
CPC ..... *F04C 28/08* (2013.01); *F04C 28/24* (2013.01); *F04C 2220/10* (2013.01); *F04C 2270/05* (2013.01); *F04C 2270/18* (2013.01); *F04C 2270/19* (2013.01); *F04C 2270/42* (2013.01); *F04C 2270/44* (2013.01)

(58) Field of Classification Search
CPC ..... F04C 2220/10; F04C 2270/05; F04C 2270/18; F04C 2270/19; F04C 2270/42; F04C 2270/44
See application file for complete search history.

(56) References Cited

U.S. PATENT DOCUMENTS 3,642,384 A * 2/1972 Huse ..... F04C 19/00 417/69
3,922,110 A * 11/1975 Huse ..... F04B 9/02 60/431
3,956,072 A * 5/1976 Huse ..... B01D 1/289 202/180
4,505,647 A * 3/1985 Alloca ..... F04B 37/14 417/252
4,699,570 A * 10/1987 Bohn ..... F04C 28/02 417/69
4,770,609 A * 9/1988 Uchida ..... F04C 28/08 417/247
4,990,069 A * 2/1991 Guittet ..... F04C 27/009 418/104
5,039,280 A * 8/1991 Saulgeot ..... F04B 49/022 417/205
5,131,817 A * 7/1992 Pastore, Jr. ..... F04C 29/042 417/205
5,244,353 A * 9/1993 Paquet ..... F04C 28/24 417/205
5,595,477 A * 1/1997 Amlinger ..... F04D 25/16 417/205
6,004,109 A * 12/1999 Gebele ..... F04C 25/02 417/205
6,802,696 B1 * 10/2004 Verhaegen ..... F04C 28/08 417/2
7,226,280 B1 * 6/2007 Yokoi ..... F04C 15/0049 418/206.4
8,287,250 B2 * 10/2012 Tanigawa ..... F04C 28/26 417/252
8,573,956 B2 * 11/2013 Suzuki ..... F04C 23/001 418/101
9,541,088 B2 * 1/2017 Kawamura ..... C23C 16/4412
2003/0077182 A1 * 4/2003 Naito ..... F04C 29/04 417/244
2005/0118035 A1 * 6/2005 Naito ..... F04C 25/02 417/244
2006/0222506 A1 * 10/2006 Rival ..... F04C 28/10 417/2
2008/0063536 A1 * 3/2008 Koshizaka ..... F04C 28/06 417/462
2012/0051948 A1 * 3/2012 Dirscherl ..... F04C 11/005 417/66
2013/0280062 A1 * 10/2013 Suzuki ..... F04C 23/001 415/213.1
2014/0093412 A1 * 4/2014 Stones ..... F04C 18/086 418/209
2014/0205482 A1 * 7/2014 Crochet ..... F04C 25/02 418/5

FOREIGN PATENT DOCUMENTS

EP 2194275 A2 * 6/2010
EP 2949938 B1 * 10/2018
WO WO-2014072276 A1 * 5/2014

* cited by examiner

POWER SAVING VACUUMING PUMP SYSTEM BASED ON COMPLETE-BEARING-SEALING AND DRY-LARGE-PRESSURE-DIFFERENCE ROOT VACUUMING ROOT PUMPS

The invention is a continuation in part (CIP) of the U.S. patent application Ser. No. 16/316,626 filed at Jan. 10, 2019, invented and assigned to the inventor of the present invention, and thus the contents of the U.S. patent application Ser. No. 16/316,626 is incorporated into the present invention as a part of the specification.

FIELD OF THE INVENTION

The present invention is related to vacuum systems, and in particular to a power saving vacuuming pump system based on complete-bearing-sealing and dry-large-pressure-difference root vacuuming root pumps.

BACKGROUND OF THE INVENTION

In thermal power plants, vacuuming of a gas condenser has a great contribution to the coal consumption. For example, if a 300 to 330 MW pump set is used as an example, when the vacuum is promoted with a value of 1 Kpas, the coal consumption is reduced with a value of 2.6 g/kWh. Currently, the commonly used vacuuming equipment is water jetting vacuum pump, water or liquid circulation pump, or vapor vacuum pump. These water-based pumps have a highly relationship with water temperature or pressure, or other environment factors. Therefore, their efficiency are low and difficult to be controlled. To retain the whole vacuum efficiency, a plurality of vacuum pumps are used, while this way greatly increases power consumption. To reduce the power consumption in the vacuum pump of the gas condenser, the following ways are used.

1. A cooling device is further added so as to reduce the working temperature, but since water circulation system is used in power plants, in summer, the circulation water temperature is increased and the temperature of the working liquid cannot be reduced effectively. If cooling system is added thereto, the power consumption will be increased further.
2. If a high efficiency double stage water circulation pump is used to replace the original single stage water circulation pump, only 20% to 30% of power is saved. Efficiency of power consumption is finite.
3. If an air jet is added to cancel the confinement of the optimum pumping ability of the vacuum pump to the pressure of condenser, this way will reduce the air pumping amount and increases the power consumption.
4. If a power saving vacuum device of a liquid circulation pump is equipped with a gas cooling root pump, this way need reuse a part of draining mixing gas which need pass through a large scale heat exchanger and this part of mixing gas returns to the root pump to cool the pump. However, this will reduce the overall efficiency. Furthermore the gas cooling root vacuum pump occupies a larger space, is heavy, and has a large power consumption and high maintenance fees. This is unbeneficial to the system arrangement and operation efficiency. Otherwise, in the market, the system is not completely sealed along the whole shaft. As a result, a large ratio of vacuum oil is ineffective and the bearings are not operated effectively.

5. A multistage (5-7) water cooling root pump is used, however, this will induce water enters into the root pump and thus evaporates. As a result, the gas pumping effect is reduced in the root pump. Furthermore too many stages of the root pumps will induce the complexity of the system. Therefore, it is not used practically.
6. If a system uses general used root pumps, this way will adapt that the bearings and vacuum fuel tank cannot be completely sealed. It is not a sealing system for all the shaft. Furthermore a pressure difference for a commonly used root pump is below 5000 Pas, and thus it cannot suffer from a larger pressure difference (several thousands Pas to several tenths of thousands Pas). Therefore, in the application of power plants, it is very easy to induce the emulsion and drainage of vacuum oil due to the permeation of vapor and thus the bearing cannot be effectively acted. Or the shaft is thermally deformed so as to deadly lock the system, as a result, the system is ineffectively.

Therefore, the present invention desires to provide a novel system which can improve the defects in the prior art.

SUMMARY OF THE INVENTION

Accordingly, the object of the present invention is to provide a power saving vacuuming pump system based on complete-bearing-sealing and dry-large-pressure-difference root vacuuming root pumps, wherein the present invention is suitable for power plant condensers or large scale liquid circulation vacuum pumps, vapor vacuum pumps, centrifugal vacuum pumps, water flushing vacuum pumps and other low efficiency vacuum pumps, etc. The present invention can achieve the function of power saving and reduction of waste drainage. The present invention also uses PLC and frequent variable electric control. Data can be continuous gathered according to the operation experience of power plants, change of weathers, loading of power generation, operation states of each pumps in the pump set. Rotation speed of each vacuum pump can be adjusted automatically or semi-automatically and the object of power saving is also achieved simultaneously. When the vacuuming is high or the air pumping is large in a large scale condenser of a large power plant, a root vacuum pump set with three pumps can be used so as to achieve the object of operation.

To achieve above object, the present invention provides a power saving vacuuming pump system based on complete-bearing-sealing and dry-large-pressure-difference root vacuuming root pumps, comprising:

an input valve 9 being an air driving valve at an input end of a vacuum space for receiving gas mixture of saturation water vapor and non-condensed air from a condenser of a power plant, and the input gas mixture being transferred to a next stage;

a first root vacuum pump 1 connected to the input valve 9 for receiving gas mixture from the input valve 9 and then compressing the gas mixture, and then transferring the compressed gas mixture out;

a second root vacuum pump 2 connected to the first root vacuum pump 1 for receiving gas mixture from the first root vacuum pump 1 and then compressing the gas mixture, and then transferring the compressed gas mixture out;

wherein each of the first root vacuum pump 1 and the second root vacuum pump 2 comprises a casing 31 having an inlet 311 and an outlet 312; an interior of the casing 31 is formed with a vacuum chamber 32 and two bearing chambers 33 at two sides of the vacuum chamber 32; the vacuum chamber 32 is connected to the inlet 311 and the outlet 312; a driving shaft 34 is installed within the casing 31 and penetrates through the vacuum chamber 32 and the two bearing chambers 33; one end of the driving shaft 34 passes out of a right wall 315 of the casing 31; a blade set 35 is installed within the vacuum chamber 32 and arranged around the driving shaft 34; the gas mixture inputs the vacuum chamber 32; by rotation of the blade set 35, the gas mixture is compressed; inner connection walls 313, 314 between the vacuum chamber 32 and the two bearing chambers (33) are installed with respective bearings 36 which are arranged to be around the driving shaft 34; as well as an opening of the right wall 315 of the casing 31 is formed with another bearing 36 around the driving shaft 34; the bearings 36 support the driving shaft 34; the bearings 36 completely seal spaces between the driving shaft 34 and the inner walls of the casing 31 so that the vacuum chamber 32 is completely isolated from the two bearing chambers 33; therefore, liquid out of the casing 31 and in the two bearing chambers 33 cannot permeate into the vacuum chamber 32; furthermore, the gas mixture in the vacuum chamber 32 cannot enter into the bearing chambers 33; therefore, in operation, interior of the vacuum chamber 32 of the first root vacuum pump 1 only has original air and the gas mixture without any impurities; moreover, liquid within the bearing chambers 33 cannot drain out of the casing 31; and wherein an inlet of the second root vacuum pump 2 is serially connected to an outlet of the first root vacuum pump 1; and wherein each of the first root vacuum pump 1 and the second root vacuum pump 2 has a structure which can suffer a great pressure difference; the great pressure means that the first root vacuum pump 1 and the second root vacuum pump 2 can operate under an inlet pressure of 5000 Pa to 30000 Pa in a whole day under a condition that the condenser is in a vacuum state and can suffer from a pressure difference larger than 5000 Pa.

DETAILED DESCRIPTION OF THE INVENTION

In order that those skilled in the art can further understand the present invention, a description will be provided in the following in details. However, these descriptions and the appended pumping are only used to cause those skilled in the art to understand the objects, features, and characteristics of the present invention, but not to be used to confine the scope and spirit of the present invention defined in the appended claims.

With reference to FIGS. 1 to 7, the structure of the present invention is illustrated. In the present invention, the root pump of specific structure is used, that is, the root pump is sealing between the chambers along the shaft of the root pump and moreover, the root pump has the ability of suffering from larger pressure difference and endurance of high temperature.

Figure 1:
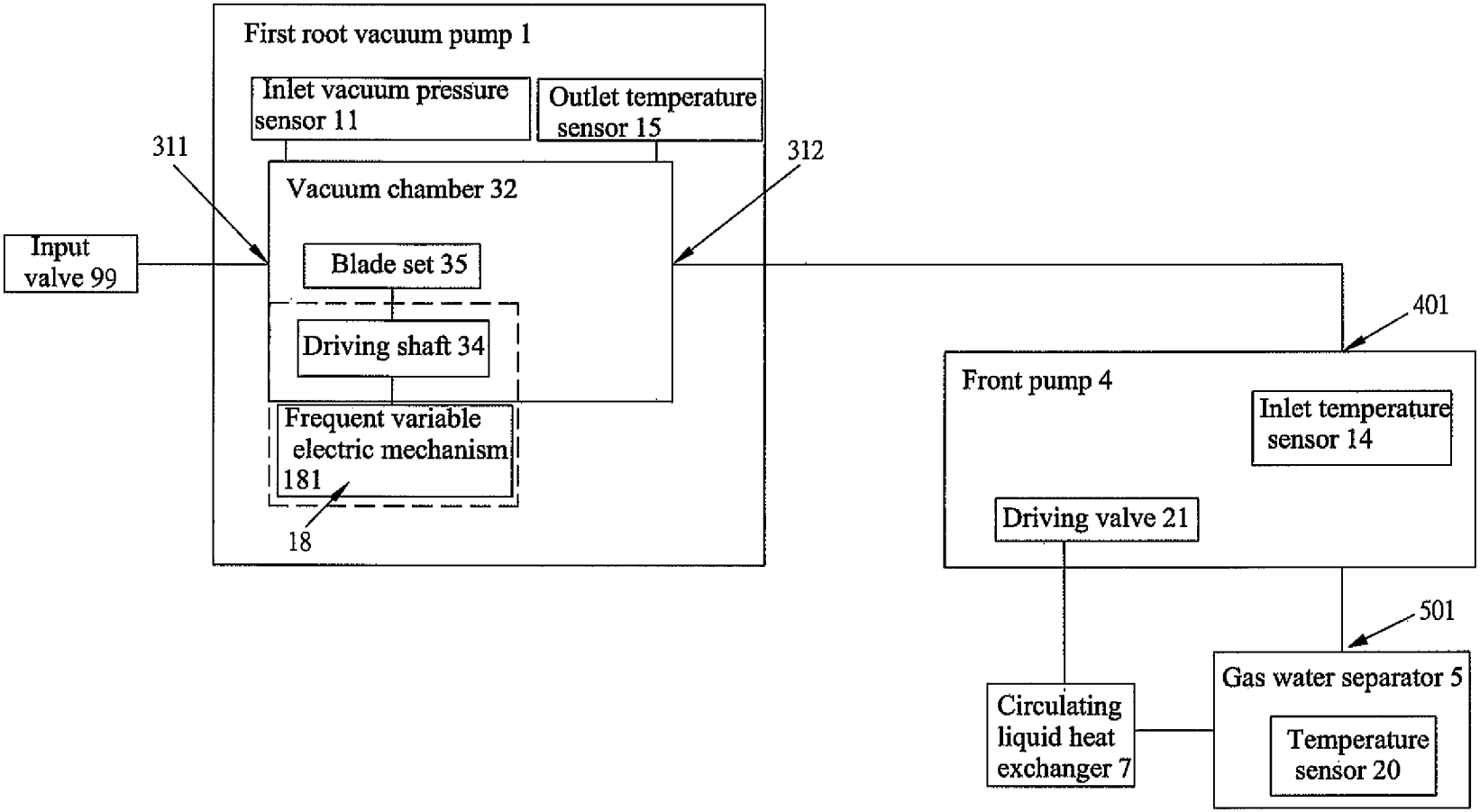
FIG. 1 is a structure block diagram of the first embodiment of the present invention.

FIG. 1 shows the first the embodiment of the present invention, in that a first root vacuum pump 1 and a front pump 4 are used. The present invention includes the following elements.

An input valve 9 is an air driving valve at an input end of a vacuum space for receiving gas mixture of saturation water vapor and non-condensed air from a condenser (not shown) of a power plant, and the input gas mixture is transferred to a next stage device.

A first root vacuum pump 1 is connected to the input valve 9. The first root vacuum pump 1 serves to receive the gas mixture gas from the input valve 9, then condense the gas mixture and then the condensed gas mixture is outputted to a following stage.

Figure 2:
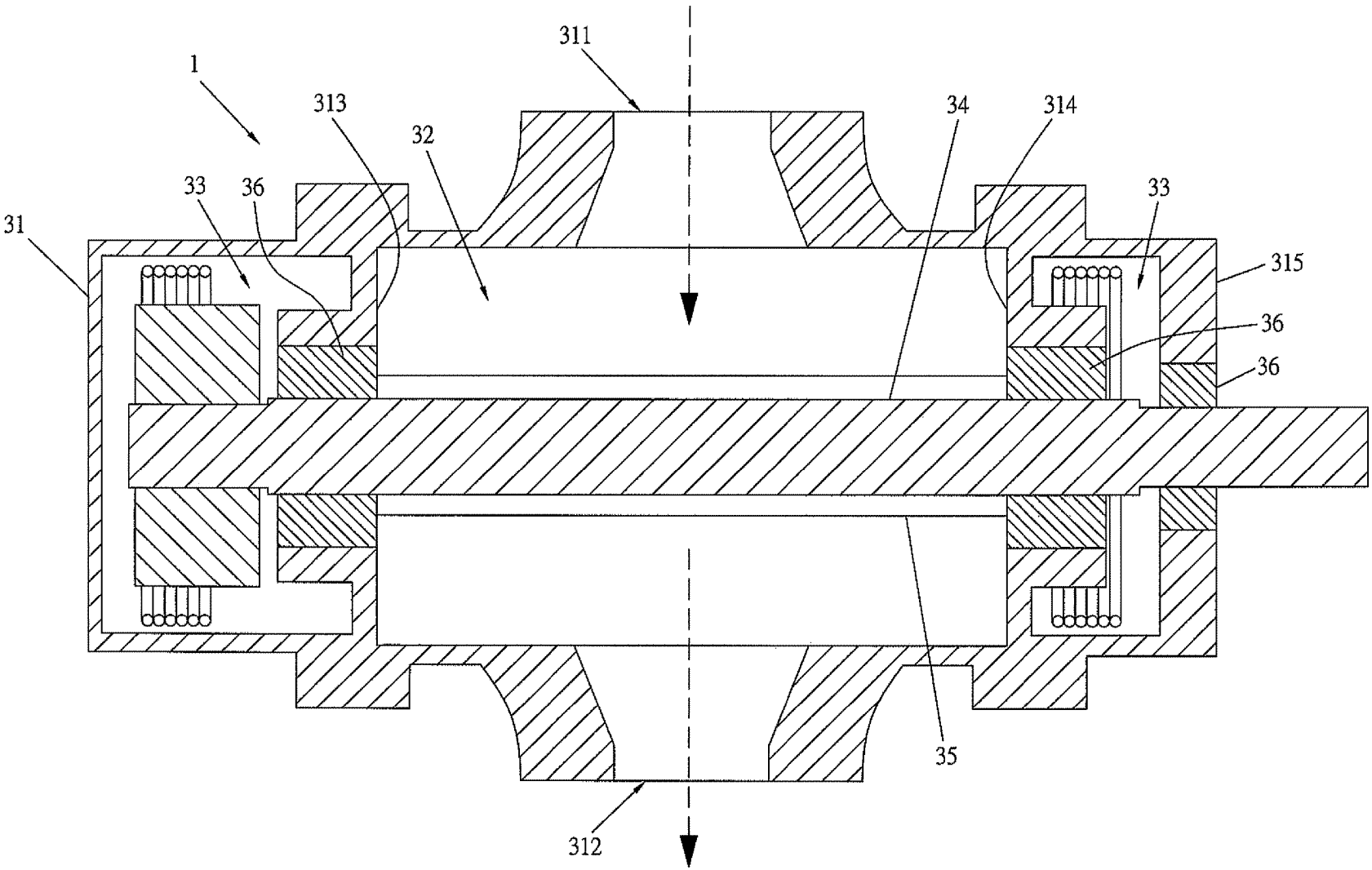
FIG. 2 is a cross section view of the first root pump of the present invention.

With reference to FIG. 2, the first root vacuum pump 1 showing a casing 31 having an inlet 311 and an outlet 312. An interior of the casing 31 is formed with a vacuum chamber 32 and two bearing chambers 33 at two sides of the vacuum chamber 32. The vacuum chamber 32 is connected to the inlet 311 and the outlet 312. A driving shaft 34 is installed within the casing 31 and penetrates through the vacuum chamber 32 and the two bearing chambers 33. One end of the driving shaft 34 passes out of a right wall 315 of the casing 31. A blade set 35 is installed within the vacuum chamber 32 and is installed on the driving shaft 34. The gas mixture inputs the vacuum chamber 32. By rotation of the blade set 35, the gas mixture is compressed.

Inner connection walls 313, 314 between the vacuum chamber 32 and the two bearing chambers 33 are installed with respective bearings 36 which are arranged to be around the driving shaft 34; as well as an opening of the right wall 315 of the casing 31 is formed with another bearing 36 around the driving shaft 34. The bearings 36 support the driving shaft 34. The bearings 36 completely seal spaces between the driving shaft 34 and the inner walls of the casing 31 so that the vacuum chamber 32 is completely isolated from the two bearing chambers 33. Therefore, liquid out of the casing 31 and in the two bearing chambers 33 cannot permeate into the vacuum chamber 32. Furthermore, the gas mixture in the vacuum chamber 32 cannot enter into the bearing chambers 33. Therefore, in operation, interior of the vacuum chamber 32 of the first root vacuum pump 1 only has original air and the gas mixture without any impurities. Moreover, liquid within the bearing chambers 33 cannot drain out of the casing 31.

In the present invention, the complete sealing structure is used, which is not half-sealed structure. Therefore, in the present invention, the vacuum chamber 32, bearing chambers 33 and other related driving structures (such as gears) are completely isolated from liquid so as to avoid of the problems of vapors, emulsions or drainages, etc.

The first root vacuum pump 1 has a structure which can suffer a great pressure difference. The great pressure means that the first root vacuum pump 1 can operate under an inlet pressure of 5000 Pa to 30000 Pa in a whole day under a condition that the condenser is in a vacuum state and can suffer from a pressure difference of 5000 Pa to 10000 Pa. General prior root vacuum pump cannot work under this condition.

The first root vacuum pump 1 is a high temperature tolerance pump, that is, the first root vacuum pump 1 can suffer from temperature greater than 130° C. In operation, the gas temperature of the vacuum chamber 32 of the first root vacuum pump 1 will achieve to 200° C.

The first root vacuum pump 1 further includes a driving unit 18 for driving the blade set 35 within the vacuum chamber 32. The driving unit 18 includes the driving shaft 34 and a frequent variable electric mechanism 181. The frequent variable electric mechanism 181 serves to drive the driving shaft 34 to drive the blade set 35 so that the gas mixture within the vacuum chamber 32 to be compressed. The frequent variable electric mechanism 181 may include a frequent variable electric motor the frequency of input power thereof is adjustable as necessary so as to adjust the rotation speed of the motor.

A front pump 4 has an input end 401 which is connected to the outlet 312 of the first root vacuum pump 1. The front pump 4 receives the gas mixture outputted from the first root vacuum pump 1 and then compresses and mixes it as gas water mixture. The front pump 4 may be a single stage pump or a double stage liquid circulation pump, a gas jet pump, a screwed rod pump or other root pump or various forms of pumps. The input end 401 of the front pump 4 has an inlet temperature sensor 14 for measuring temperatures at the input end 401 of the front pump 4.

A gas water separator 5 has an input end 501 which is connected to the front pump 4. The gas water mixture of the front pump 4 is inputted to the gas water separator 5 for separating gas and water and draining out the separated gas and water. The gas water separator 5 includes a temperature sensor 20 for measuring water temperature of the gas water separator 5 and transferring out the measuring data.

When the front pump 4 is a liquid circulation pump, liquid separated from the gas water separator 5 is cooled by a circulating liquid heat exchanger 7 for cooling and then returning back to the front pump 41. An air driving valve 21 is installed at the connection of the front pump 4 and the circulating liquid heat exchanger 7 for controlling the flow rate of the liquid inputting to the front pump 4 after the water is separated by the gas water separator 5. When the system of the present invention is needed to be started or stopped, or is destroyed, by controlling the opening and closing the air driving valve 21, the liquid flowing into the front pump 4 is controlled not to be over the necessary amount so as to avoid that the system is necessary to be stopped and thus the liquid is returning back or be overflow.

Figure 3:
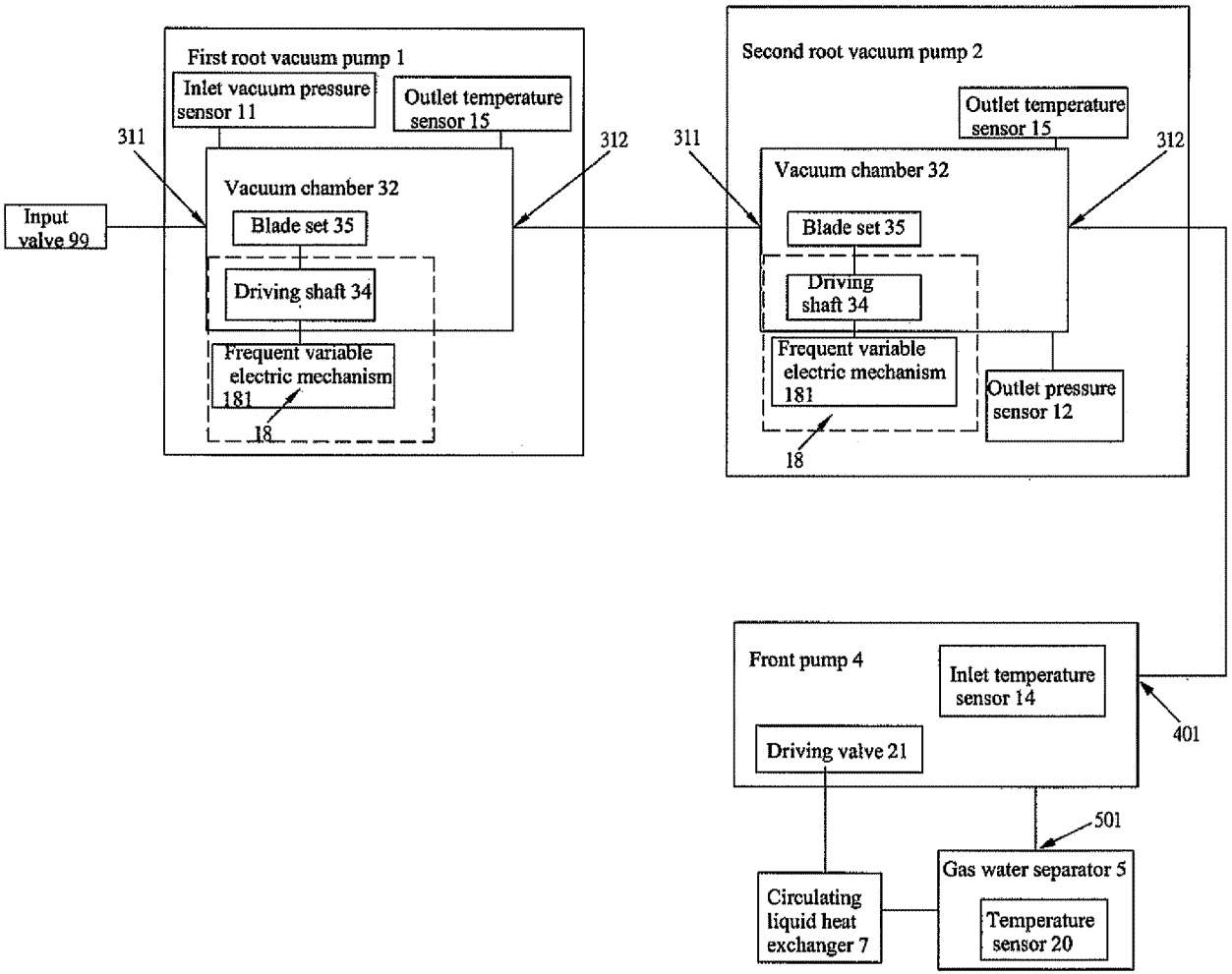
FIG. 3 is a structural block diagram of the second embodiment of the present invention.

FIG. 3 shows the second embodiment of the present invention, in this the present invention, the outlet 312 of the first root vacuum pump 1 is serially connected with a second root vacuum pump 2 and then it is further serially to the front pump 4. However, the elements in this embodiment identical to those in the first embodiment are illustrated by the same numerals and have the same functions, and therefore, the details will not be further described herein.

A second root vacuum pump 2 has a structure identical to that in the first embodiment. An inlet 311 of the second root vacuum pump 2 is serially connected to the outlet 312 of the first root vacuum pump 1. The second root vacuum pump 2 serves to further compress gas mixture outputted from the first root vacuum pump 1. Then the compressed gas mixture is further outputted to the succeeding stage.

The front pump 4 is serially connected to the outlet 312 of the second root vacuum pump 2. The front pump 4 serves to further compress the output gas mixture outputted from the second root vacuum pump 2 and then transfers them out.

In the present invention, a feedback mechanism of pressure and temperature is further included in the present invention so that the system has a higher efficiency. In that, the first root vacuum pump 1 further includes an inlet vacuum pressure sensor 11 at the inlet 311 and an outlet temperature sensor 15 at the outlet 312. The second root vacuum pump 2 further includes an outlet pressure sensor 12 at the outlet 312 and an outlet temperature sensor 15. According to the pressure values detected at the inlet vacuum pressure sensor 11 and the outlet pressure sensor 12, and temperature values detected at the outlet temperature sensors 15 at the first root vacuum pump 1 and the second root vacuum pump 2, the system analyses and integrates these values and then transfers control signals to the frequent variable electric mechanisms 181 of the first root vacuum pump 1 and the second root vacuum pump 2 for adjusting the rotation speeds of the frequent variable electric mechanisms 181 thereof so that the whole system achieves an optimum efficiency and has a safety operation.

Figure 4:
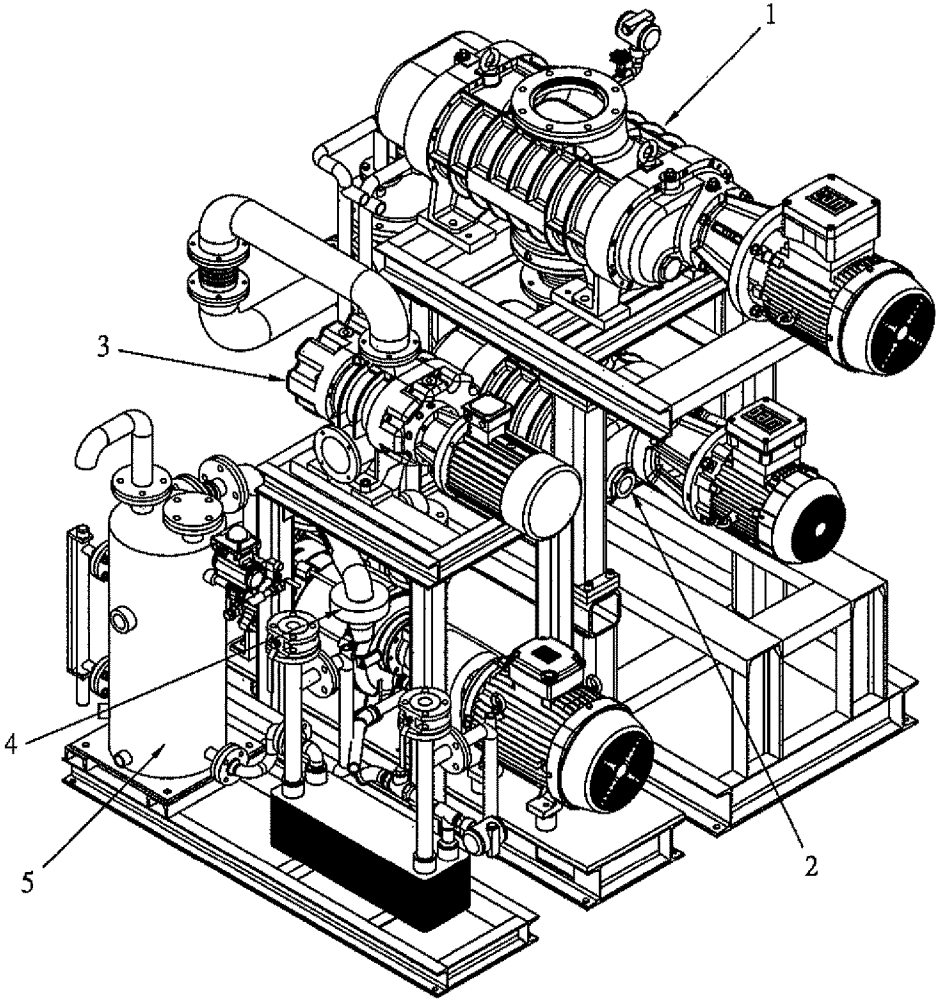
FIG. 4 shows the structure in the third embodiment of the present invention.
Figure 5:
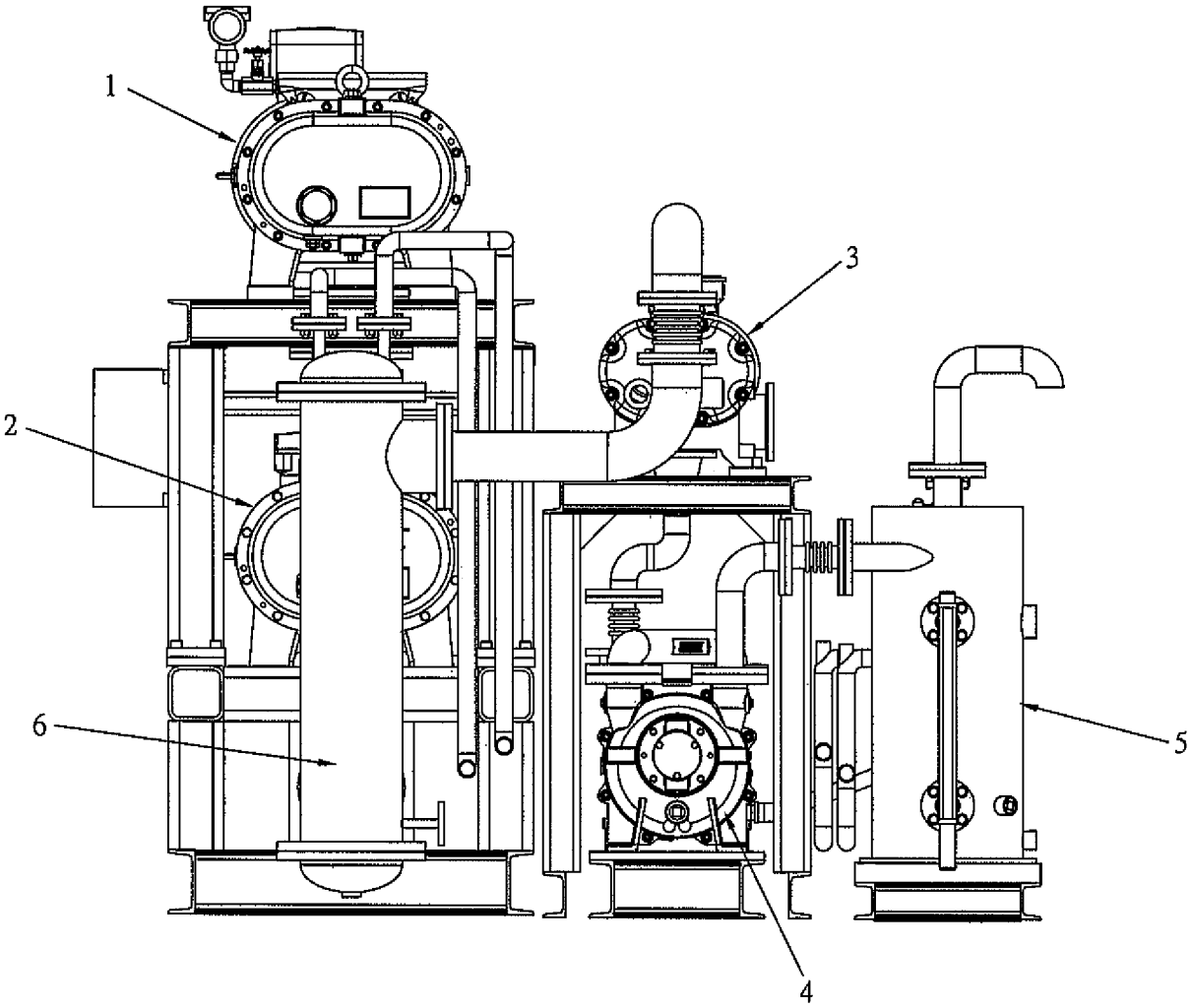
FIG. 5 is a lateral view of FIG. 4.
Figure 6:
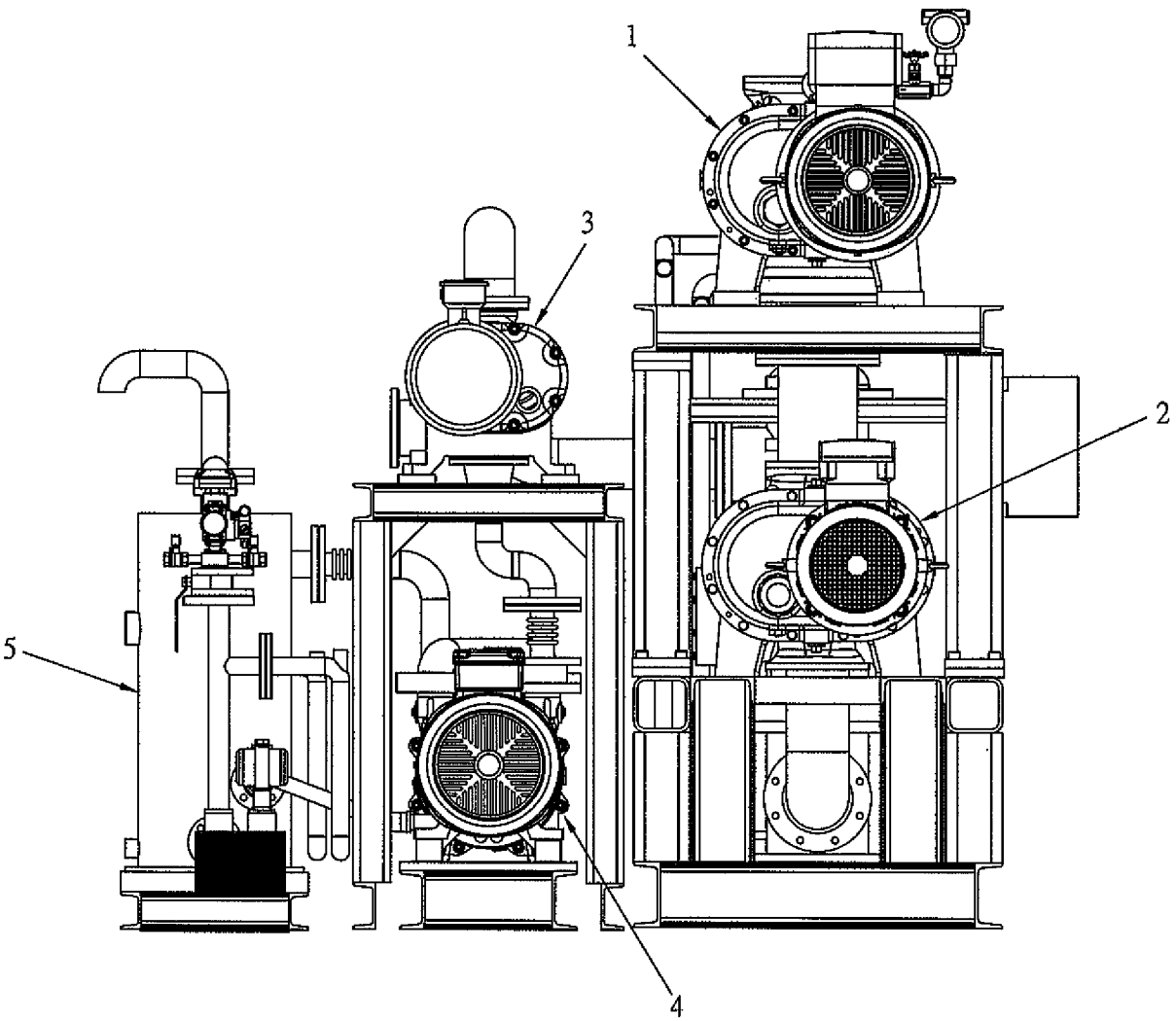
FIG. 6 is another lateral view of the FIG. 4.
Figure 7:
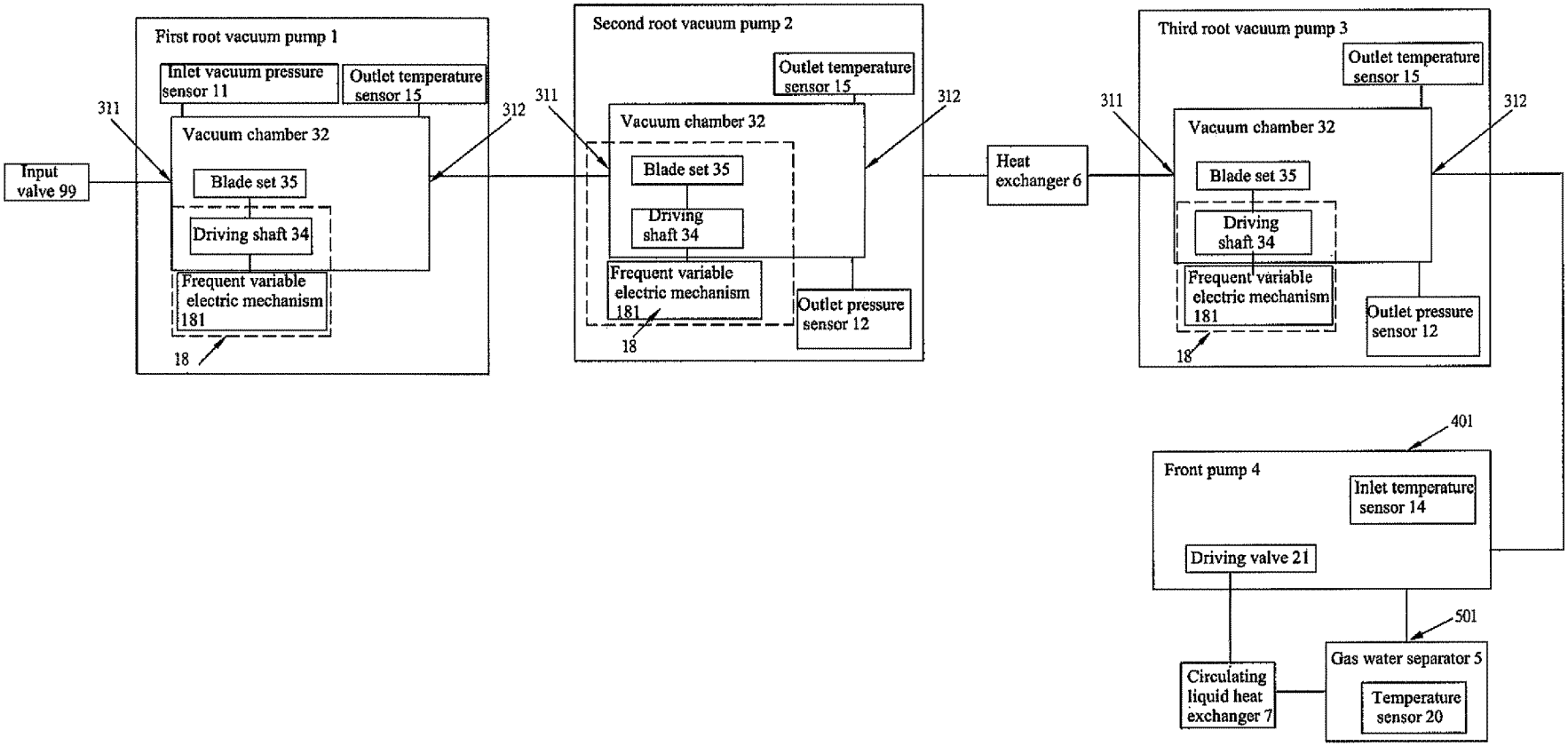
FIG. 7 is a structural block diagram of the third embodiment of the present invention.

FIGS. 4 and 7 show the third embodiment of the present invention. In that, the outlet 312 of the second root vacuum pump 2 is serially connected with a third root vacuum pump 3 and then the third root vacuum pump 3 is further serially connected to the front pump 4. This embodiment is suitable for the case that the drainage of the condenser is great in a large size power plant (such as the capacity of the power plant is larger than 1000 MW) or wind cooling condensers. In this embodiment, those elements identical to the elements in above embodiment are illustrated by the same numerals and have the same functions. Therefore, the details of these elements are not further described. The embodiment further includes the following elements.

A third root vacuum pump 3 has the same structure as described in the first root vacuum pump 1. An inlet 311 of the third root vacuum pump 3 is serially connected to the outlet 312 of the second root vacuum pump 2. The third root vacuum pump 3 is used to further compress the gas mixture outputted from the second root vacuum pump 2 and then the compresses gas mixture is transferred to the next stage.

The front pump 4 is serially connected to the outlet 312 of the third root vacuum pump 3 and is used to further compress the gas mixture from the third root vacuum pump 3 and then transfer the compressed gas mixture out.

A heat exchanger 6 can be connected between the outlet 312 of the second root vacuum pump 2 and the inlet 311 of the third root vacuum pump 3 for temperature reduction to the gas mixture outputted from the second root vacuum pump 2.

In above second embodiment, the first root vacuum pump 1 and second root vacuum pump 2 may be formed as an integral structure; and in the third embodiment, the first root vacuum pump 1, second root vacuum pump 2 and third root vacuum pump 3 may be formed as an integral structure, that is, they are integrated as a single structure. Or in the second and third embodiment, all the root vacuum pumps are independent.

In above third embodiment, feedback control of pressure and temperature can be used, wherein the third root vacuum pump 3 further includes an outlet pressure sensor 12 and an outlet temperature sensor 15 at the outlet 312. Based on the detected pressures at the inlet vacuum pressure sensor 11 and the outlet pressure sensor 12 and temperature values detected at the outlet temperature sensors 15 at the first, second and third root vacuum pumps 1, 2 and 3, the system analyses and integrates these values and then transfers control signals to the frequent variable electric mechanisms 181 of the first root vacuum pump 1, the second root vacuum pump 2 and the third root vacuum pump 3 for adjusting the rotation speeds of the frequent variable electric mechanisms 181 thereof so that the whole system achieves to an optimum efficiency and has a safety operation.

The advantages of the present invention are that: inner connection walls between the vacuum chamber 32 and the two bearing chambers 33 are installed respective bearings 36 which are installed to be around the driving shaft 34, and thus all the vacuum chamber 32 and the two bearing chambers are tightly sealed. The vacuum chamber 32 is completely dried so as to prevent from internal emulsion due to saturation vapors therein. The waste oil will not flow into the vacuum chamber due to the pressure variation, or condensed water is condensed in fuel tank so as to prevent vacuum lubrication oil in the bearing chamber entering into the vacuum chamber. Therefore, in the present invention, the bearing and blade set in the root vacuum pump can be retained in an efficiency operation for a long time.

Therefore, the present invention is suitable for power plant condensers or large scale liquid circulation vacuum pumps, vapor vacuum pumps, centrifugal vacuum pumps, water flushing vacuum pumps and other low efficiency vacuum pumps, etc. The present invention can achieve the function of power saving and reduction of waste drainage. The present invention also uses PLC and frequent variable electric control. Data can be continuous gathered according to the operation experience of power plants, change of weathers, loading of power generation, operation states of each pumps in the pump set. Rotation speed of each vacuum pump can be adjusted automatically or semi-automatically and the object of power saving is also achieved simultaneously. When the vacuuming is high or the air pumping is large in a large scale condenser of a large power plant, a root vacuum pump set with three pumps can be used so as to achieve the object of operation.

In the present invention, before the gas mixture entering the front pump, it is compressed by one or several root pumps so as to reduce the volume thereof. Then the front pump with a power ratio far smaller than the large water circulation pump, or vapor pump, or centrifugal pump is used to drain out the compressed gas to atmosphere. As a result, the power consumption of the system is reduced greatly. Furthermore the drain amount of the liquid, vapor or water of the front pump is also greatly reduced.

As comparing with the prior the large water circulation pump, or vapor pump, or centrifugal pump, the power consumption of the present invention is reduced with a ratio of 65%'85%. As comparing with the root pump with vacuum device of liquid circulation pump, the ratio of further reduced with a ratio of 25%-35%. Furthermore the area occupied by the present invention is only one fourth of a large scale water circulation pump set or 70% of a gas cooling root pump set. The present invention is a structure with minimum power consumption and area occupation. Furthermore, the vacuuming of the present invention is mainly determined by the root vacuum pump, and thus the effect of temperature is smaller. If the original vacuum system has a large drainage, the present invention can promote the vacuuming of a condenser. Therefore, the system of the present invention is suitable for the vacuum system of a condenser of a thermal power plant. Furthermore the elements of the present invention have small volume, as a result, the annular maintenance and cost are also smaller than a large scale liquid circulation pump system. Moreover, because the sealing is complete along the whole bearing, the destroy is obviously smaller then gas cooling root pump.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power-saving vacuum pump system, comprising: an input valve at an input end of a the power-saving vacuum pump system for receiving a gas mixture of saturated water vapor and non-condensed air from a condenser of a power plant; a first root vacuum pump connected to the input valve, receiving the gas mixture from the input valve and then compressing the gas mixture, and then transferring the compressed gas mixture out; a second root vacuum pump connected to the first root vacuum pump, receiving the gas mixture from the first root vacuum pump and then compressing the gas mixture, and then transferring the compressed gas mixture out; a third root vacuum pump connected to the second root vacuum pump, receiving the gas mixture from the second root vacuum pump and then compressing the gas mixture, and then transferring the compressed gas mixture out; wherein each of the first root vacuum pump, the second root vacuum pump, and the third root vacuum pump comprises a casing having an inlet and an outlet; an interior of the casing being formed with a vacuum chamber and two bearing chambers at two sides of the vacuum chamber; the vacuum chamber being connected to the inlet and the outlet; a driving shaft being installed within the casing and penetrating through the vacuum chamber and the two bearing chambers; one end of the driving shaft passing out of a right wall of the casing; a blade set being installed within the vacuum chamber and arranged around the driving shaft; wherein by rotation of the blade set, the gas mixture enters the vacuum chamber and is compressed; wherein inner connection walls between the vacuum chamber and the two-bearing chambers comprise respective bearings arranged around the driving shaft; wherein an opening is formed in the right wall of the casing and comprises another bearing arranged around the driving shaft; wherein the bearings support the driving shaft and completely seal spaces between the driving shaft and the inner walls of the casing so that the vacuum chamber is completely isolated from the two bearing chambers, liquid in the two bearing chambers cannot permeate into the vacuum chamber, and the gas mixture in the vacuum chamber cannot enter into the bearing chambers; wherein, in operation, the vacuum chamber of the first root vacuum pump receives the gas mixture from the input valve and liquid within the bearing chambers cannot drain out of the casing; wherein the inlet of the second root vacuum pump is serially connected to the outlet of the first root vacuum pump and the inlet of the third root vacuum pump is serially connected to the outlet of the second root vacuum pump; wherein each of the first root vacuum pump, the second root vacuum pump, and the third root vacuum pump is capable of withstanding an inlet pressure of 5000 Pa to 30000 Pa under a condition that the condenser is in a vacuum state and a pressure difference larger than 5000 Pa; wherein each of the first root vacuum pump, the second root vacuum pump, and the third root vacuum pump operates at temperatures higher than 130° C.

2. The power-saving vacuum pump system as claimed in claim 1, wherein a heat exchanger is installed between the outlet of the second root vacuum pump and the inlet of the third root vacuum pump for reducing a temperature of the gas mixture output from the second root vacuum pump.

3. The power-saving vacuum pump system as claimed in claim 1, further comprising: a front pump serially connected to the outlet of the third root vacuum pump and further compressing the gas mixture from the third root vacuum pump and transferring the compressed gas mixture out; and a gas water separator connected to the front pump for separating gas and water output from the front pump and draining out the separated water.

4. The power-saving vacuum pump system as claimed in claim 1, wherein each of the first root vacuum pump, the second root vacuum pump, and the third root vacuum pump has an integral structure.

5. The power-saving vacuum pump system as claimed in claim 1, wherein the first root vacuum pump (1) further includes an inlet vacuum pressure sensor (11) at the inlet thereof and an outlet temperature sensor (15) at the outlet thereof; the second root vacuum pump (2) further includes an outlet pressure sensor (12) and an outlet temperature sensor (15); wherein according to detected pressures from the inlet vacuum pressure sensor (11) and the outlet pressure sensor (12) and detected temperatures from the outlet temperature sensors (15), the system processes the detected pressures and temperatures and controls variable speed electric mechanisms of the first root vacuum pump (1) and the second root vacuum pump (2) in order to adjust rotation speeds of the variable speed electric mechanisms.

* * * * *